US006392509B2

(12) United States Patent
Broad et al.

(10) Patent No.: US 6,392,509 B2
(45) Date of Patent: May 21, 2002

(54) ADJUSTABLE COUPLING ARRANGEMENT FOR APERTURE COUPLED CAVITY FILTERS

(75) Inventors: Graham Broad, Lilydale; Steven Bowey, Mooroolbark, both of (AU)

(73) Assignee: Alcatel, Paris (FR)

( * ) Notice: Subject to any disclaimer, the term of this patent is extended or adjusted under 35 U.S.C. 154(b) by 7 days.

(21) Appl. No.: 09/728,090

(22) Filed: Dec. 4, 2000

(30) Foreign Application Priority Data

Dec. 6, 1999 (WO) ..... PCT/AU99/01071
Dec. 23, 1999 (AU) ..... PQ4813

(51) Int. Cl.[7] ..... H01P 1/20; H01P 1/205
(52) U.S. Cl. ..... 333/212; 333/209; 333/232
(58) Field of Search ..... 333/212, 209, 333/208, 231, 232, 230, 227, 202

(56) References Cited

U.S. PATENT DOCUMENTS 4,652,844 A * 3/1987 Brambilla ..... 333/212
6,294,970 B1 * 9/2001 Pitschi et al. ..... 333/212

* cited by examiner

*Primary Examiner*—Robert Pascal
*Assistant Examiner*—Stephen E. Jones
(74) *Attorney, Agent, or Firm*—Sughrue Mion, PLLC

(57) ABSTRACT

An adjustable coupling arrangement for aperture coupled cavity filters. According to the invention, in an electric wall (24) separating two cavities to be coupled in a bandpass filter, provide a cruciform iris (26) comprising a central aperture (27) having four slits (28,29,30, 31) extending outwardly therefrom. In each slit there is arranged a captive movable rectangular metal slug (36,37,38,39) whose position along the slit's length can be manipulated by a tool that engages the slug when the tool is introduced into a radial passageway (32,33,34 35) that connects the slit with an access hole in the filter's housing. When desired coupling parameters are achieved by manipulating each of the slugs to effectively change the electrical length of the slits, each slug is locked in position by a respective associated locking means actuated by the tool. Because a significant part of the tool is within a passageway during manipulation, the filter's characteristics are not disturbed by its presence.

7 Claims, 3 Drawing Sheets

ADJUSTABLE COUPLING ARRANGEMENT FOR APERTURE COUPLED CAVITY FILTERS

TECHNICAL FIELD

This invention relates to microwave filters and in particular to coupling arrangements for aperture coupled cavity filters.

In highly selective bandpass filters which use adjacent cavity resonators coupled by apertures in common walls, the magnitudes of such couplings are very critical parameters. An example of such a bandpass filter is disclosed in our co-pending International Application No. PCT/AU99/01071.

In order to achieve these necessary critical parameters it is known to provide a high degree of manufacturing precision. However, this solution is unattractive for large filters.

SUMMARY OF THE INVENTION

It is therefore an object of the present invention to provide an adjustable coupling aperture arrangement for adjusting the coupling between cavity resonators over a wide range of coupling values, the coupling being adjusted externally using a tool that does not disturb the filter's characteristics.

According to the invention, in a microwave filter comprising an electrically conductive housing within which is disposed at least two cavity resonators coupled by aperture means in a substantially planar wall common to both said resonators, there is provided an adjustable coupling aperture arrangement including aperture means comprising at least one slit of predetermined dimensions, the at least one slit communicating with a respective access hole in said housing via an associated passageway that lies within the boundary of said wall's major surfaces, wherein said at least one slit is provided with a movable metal slug that is slideably retained by opposite longitudinal edges of the slit, whereby said slug can be engaged and slideably manipulated by a tool means, introduced into said access hole and guided to said slug via said passageway, into a position in which electrical contact between said slug and said edges of the slit produces a desired change in effective electrical length of the slit.

BRIEF DESCRIPTION OF THE DRAWINGS

In order that the invention may be readily carried into effect, embodiments thereof will now be described in relation to the accompanying drawings, in which.

DETAILED DESCRIPTION

Figure 1:
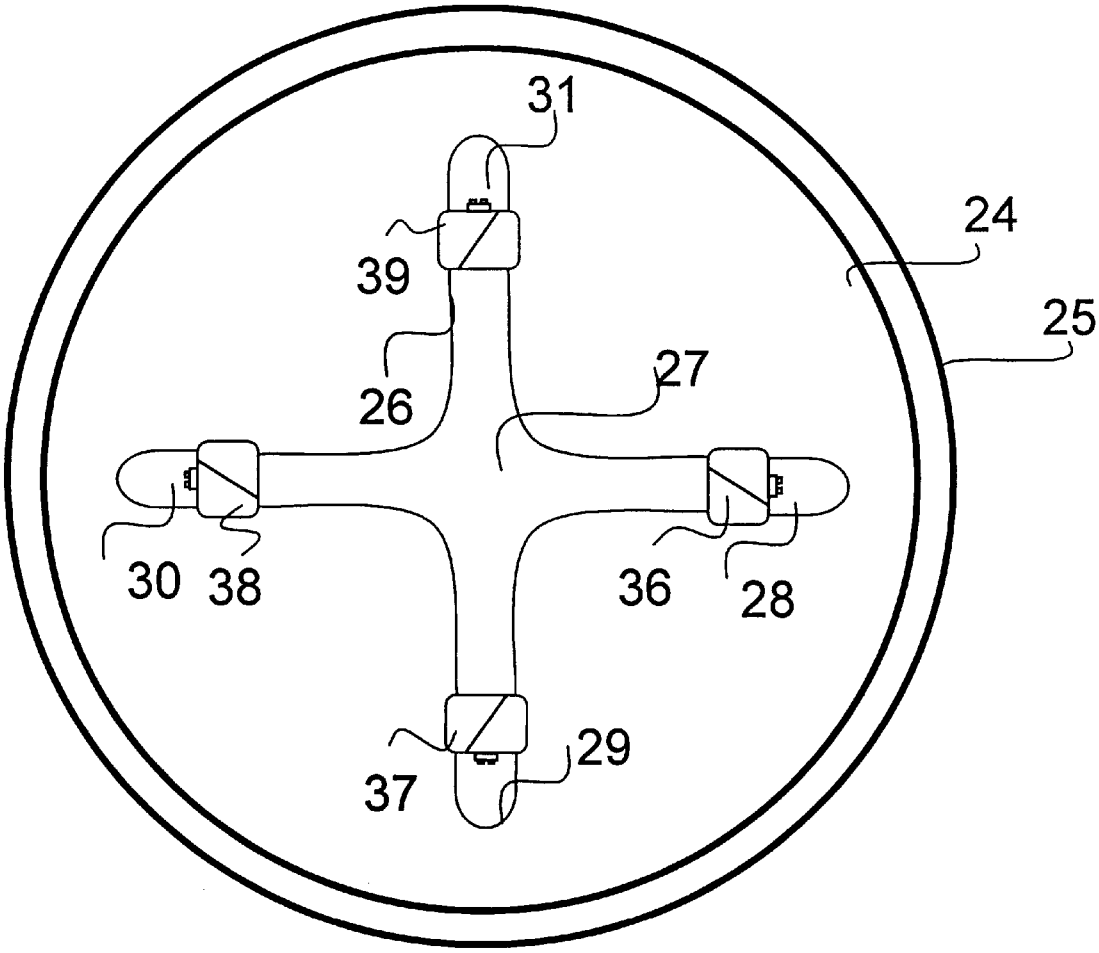
FIG. 1 is a top view of a cavity wall within a circular filter housing, the cavity wall being provided with an adjustable coupling iris.
Figure 2:
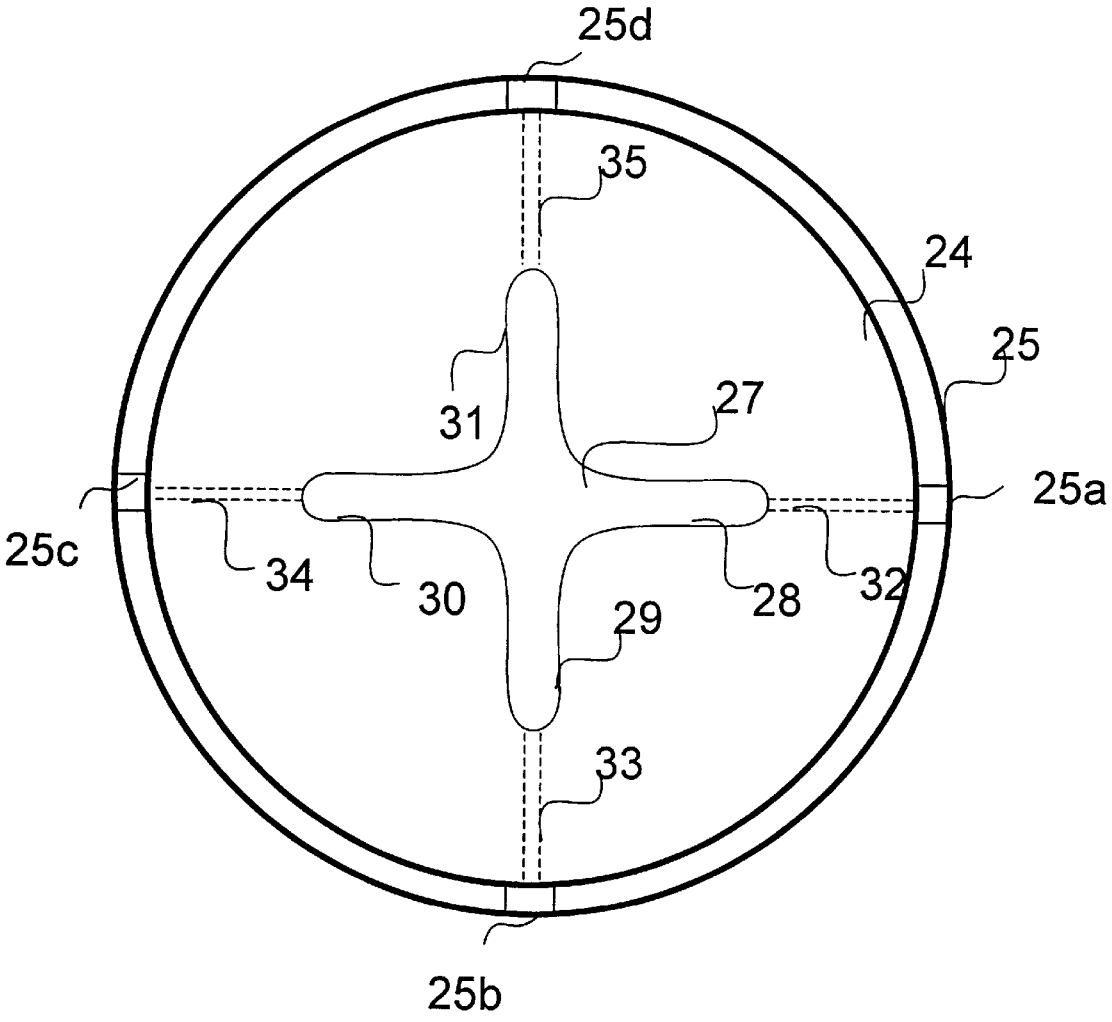
FIG. 2 is a top view of the cavity wall shown in FIG. 1, showing radial passageways connecting slits of the coupling iris to the filter housing exterior.
Figure 3:
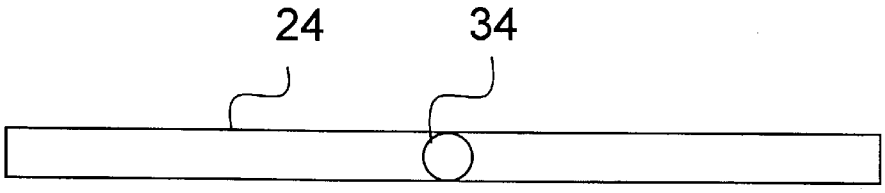
FIG. 3 is a side view of FIG. 2.

Referring to FIGS. 1 and 2, the adjustable coupling aperture arrangement comprises an electrically conductive wall 24 coaxially located within a filter housing 25. Wall 24 is provided with a cruciform iris 26 comprising a central zone 27 having four slits 28, 29, 30 and 31 extending outwardly therefrom. Each slit is connected by a radial passageway 32, 33, 34 and 35 to respective apertures 25*a*, 25*b*, 25*c* and 25*d* in the filter housing permitting access to the slits from the exterior of the filter housing. The passageways are within the boundary of the wall's opposite surfaces. In each slit is arranged a captive, movable, rectangular metal slug 36, 37, 38 and 39.

Referring to FIGS. 4–7, each rectangular slug comprises two sections A and B each in the form of general trapezoids whose respective non-parallel sides 40 and 41 interface. The two sections are held together by a screw 42. One section, A, is provided with a threaded hole (not shown), which cooperates with the screw's thread when the screw is disposed in a bore hole in section B. The screw is provided with a slotted bayonet head 43 which allows the screw to be engaged by a tool (not shown) having a T-shaped end to allow the screw to be rotated as well as allowing the associated slug to be moved linearly.

Figure 4:
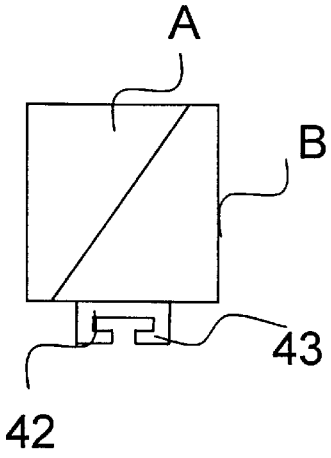
FIG. 4 is a top view of an contracted adjustment slug.
Figure 5:
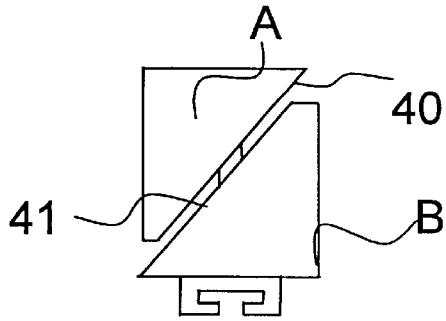
FIG. 5 is a top view of a expanded adjustment slug.
Figure 6:
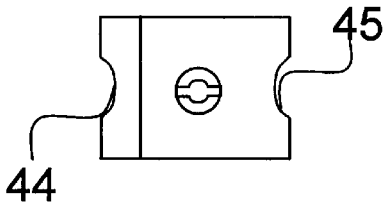
FIG. 6 is an end view of an adjustment slug.
Figure 7:
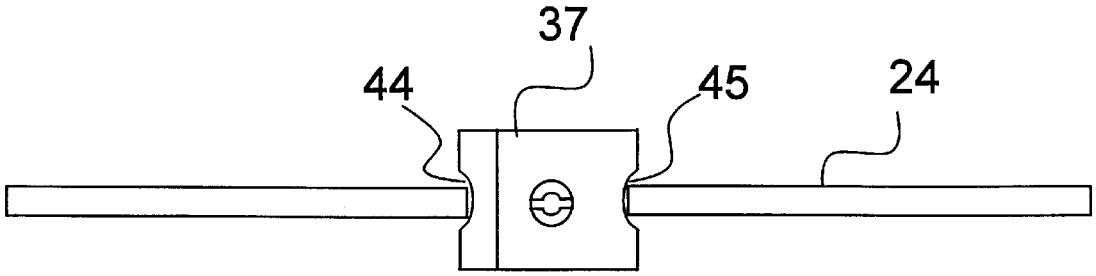
FIG. 7 is a side view of a cavity wall showing an adjustment slug located within a slit of the coupling iris.

A groove 44, 45 is provided in a side of each section A and B such that when a slug is assembled by screwing the sections together, opposite parallel grooves are formed for slideably engaging the edges of respective slits. Due to cooperation between sections A and B, the width between the sides provided with the grooves is maximum when the screw is tightened as shown in FIG. 4, and minimum when the screw is loosened as shown in FIG. 5. Referring to FIG. 7, the width is such that the slug is slideably retained in a slit when the screw is loosened, and fixedly grips and makes electrical contact with opposite edges of the slit when the screw is tightened, thereby affecting the electrical length of the slit.

In operation, slugs 36, 37, 38 and 39 are located in respective slits. Desired filter transmission and reflection characteristics are obtained, using a vector network analyser and manipulating the slugs with the tool inserted into respective passageways 32, 33, 34 and 35 via associated apertures 25*a*, 25*b*, 25*c* and 25*d*. While it is preferable to use four slugs to maintain symmetry in two principal planes, it will be understood that this is not an essential requirement.

Further, in filter arrangements where only a single slit is required, either one or two slugs could be used.

The claims defining the invention are as follows:

1. In a microwave filter comprising a housing within which is disposed at least two cavity resonators coupled by aperture means in a substantially planar wall common to both said resonators, an adjustable coupling aperture arrangement including aperture means comprising at least one slit of predetermined dimensions, the at least one slit communicating with a respective access hole in said housing via an associated passageway that lies within the boundary of said wall's major surfaces, wherein said at least one slit is provided with a movable metal slug that is slideably retained by opposite longitudinal edges of the slit, whereby said slug can be engaged and slideably manipulated by a tool means, introduced into said access hole and guided to said slug via said passageway, into a position in which electrical contact between said slug and said edges of the slit produces a desired change in effective electrical length of the slit.

2. An adjustable aperture arrangement as claimed in claim 1, wherein said slug includes a screw operated locking means arranged to be actuated by said tool means for locking said slug in said position.

3. An adjustable aperture arrangement as claimed in claim 2, wherein said slug is a rectangular-shaped block having a groove in each of two opposite parallel sides for cooperating with opposite edges of said slit for slideably retaining and gripping said block therein, said block being formed from a first trapezoid-shaped section and a second trapezoid-shaped section assembled together, with each section's non-parallel side interfacing, by a screw having a head and a threaded section, said screw's threaded section freely passing through a hole in the first trapezoid section to cooperate with a threaded hole provided in the second trapezoid-shaped section, whereby the width between said grooves can be varied by a turning adjustment of said screw with said tool means engaging the screw's head to change the positional relationship between the said interfacing non-parallel sides to cause the slug to be either slideably retained within the slit for manipulation, or fixedly locked in electrical contact with said edges of said slit.

4. An adjustable aperture arrangement as claimed in claim 3, wherein said aperture means comprises four slits of predetermined dimensions, extending outwardly from a central zone, each slit including a said slug, and each slit communicating with a respective said access hole via an associated said passageway.

5. An adjustable aperture arrangement as claimed in claim 4, wherein said planar wall is substantially circular in shape.

6. An adjustable aperture arrangement as claimed in claim 3, wherein the screw head includes a bayonet socket for cooperating with a tool having a T-shaped end.

7. An adjustable aperture arrangement as claimed in claim 1 operatively incorporated in a waveguide filter arrangement.

* * * * *